United States Patent [19]

Bouse et al.

[11] Patent Number: 4,960,297

[45] Date of Patent: Oct. 2, 1990

[54] DOUBLE ACTION LATCH

[75] Inventors: James R. Bouse, Belmont; John P. Conner, Grandville, both of Mich.

[73] Assignee: Component Hardware Group, Inc., Lakewood, N.J.

[21] Appl. No.: 413,958

[22] Filed: Sep. 28, 1989

[51] Int. Cl.[5] ..... F05C 3/16

[52] U.S. Cl. ..... 292/223; 292/DIG. 69; 126/197

[58] Field of Search ..... 126/190, 191, 197, 198; 292/DIG. 69, DIG. 71, DIG. 40, DIG. 41, DIG. 14, DIG. 4, 223, 113, 196, 226, 341.18

[56] References Cited

U.S. PATENT DOCUMENTS

| | | | |
|---|---|---|---|
| 2,397,671 | 4/1946 | Larson | 292/223 X |
| 2,659,621 | 11/1953 | Jacobson | 292/DIG. 71 X |
| 2,689,758 | 9/1954 | Orr | 292/DIG. 41 X |
| 2,698,197 | 12/1954 | Jacobson | 292/DIG. 71 X |
| 2,723,146 | 11/1955 | Dingman et al. | 292/DIG. 40 X |
| 2,868,578 | 1/1959 | Squire et al. | 292/223 |
| 3,045,465 | 7/1962 | Larson | 292/223 X |
| 4,205,867 | 6/1980 | Loikitz | 292/223 |

*Primary Examiner*—Eric K. Nicholson

*Attorney, Agent, or Firm*—Kenyon & Kenyon

[57] ABSTRACT

The double action latch employs a strike with two latches and a stop on the opposite side of the latches. The handle actuates a pivotally mounted bracket unit to cause a roller to ride over the first latch while moving a plate into a plate into engagement with the stop. This brings the door into a partially opened position, for example, for venting an oven. The handle is returned to the upright position and then a second pull is effected to move the roller over the second latch so as to permit the door to be fully opened.

22 Claims, 5 Drawing Sheets

10
41
12
11
39
24
44
23
24
47
38
15
40
16
17
14
32
25
27
21
26
32
31
30
18
19
23
24

DOUBLE ACTION LATCH

This invention relates to a double action latch. More particularly, this invention relates to a double action latch for an oven door.

As is known, various types of latches have been used for the locking and unlocking of doors. Likewise, various types of structures with doors such as ovens, have been known to have latches for securing the door in place. Generally, the latches are constructed so that upon pivoting of a handle or pressing in of a button, the latch moves from a locking position into an unlocking position so that the door can be opened to expose the contents of the structure. However, in cases of ovens that contain heat, for example in the form of hot air, steam, particularly steam under pressure, or the like opening of an oven door provides a blast of hot air or steam which may be detrimental to the person opening the oven.

Attempts have been made in the past to permit a limited opening of an oven door so as to vent the oven of hot air or steam and, thus, preclude a blast of hot air or steam blowing against a person. However, the devices which have been provided to accomplish this have been relatively cumbersome. For example, in some cases, locking devices have been provided with secondary mechanisms which require the use of a second hand in order to be able to initially open a door for venting purposes and to thereafter open the door into a fully opened position. In other cases, limiting devices have been used along with a latch so that two separate and distinct assemblies are separably mounted on a door and cabinet of oven. However, care must be taken to ensure that the limiting device has not been previously opened or somehow deactivated so that upon release of the latch, the oven door moves into the fully opened position.

Accordingly, it is an object of the invention to permit a door to be opened in two distinct pulls of a latch handle using only one hand.

It is another object of the invention to eliminate the need for presetting of any device prior to completely closing a door of an oven.

It is another object of the invention to be able to release steam and/or gas pressure in an enclosure in a slow and safe manner.

It is another object of the invention to provide a double action latch which requires successive pulls in order to be fully opened.

Briefly, the invention provides a double action latch which is comprised of a strike for mounting on a frame and a latch housing for mounting on a door pivotally secured to the frame.

The strike is constructed with a pair of latches as well as a stop. The latch housing contains a roller which is mounted for movement between a first position in alignment with the latches and a second position away from the latches as well as a plate for movement between a first position away from the stop and a second position in alignment with the stop. In addition, the housing contains an actuating means which is connected to the roller and the plate for moving the roller and plate simultaneously between the positions thereof.

The actuating means includes a handle which projects from and which is movably mounted in the housing for movement between a locking position and an unlocking position. In addition, the actuating means includes a lever which is movable by the handle and which is connected in common to the roller and plate. During operation, as the handle is first pulled into the unlocking position, the roller disengages from a first of the two latches while at the same time, the plate moves into abutment with the stop. In this intermediate position, the door is in a slightly opened position so that any steam and/or gas within the enclosure of the frame, for example an oven, can be vented. In order to open the door completely, the handle must be returned to the locking position. At this time, the roller is disposed between the two latches while the plate is disposed out of alignment with the stop. Upon actuating the handle with a second pull, the roller moves away from the second latch so that the handle can now be moved away from the strike.

A spring is also provided in the housing for biasing the handle into the locking position while a second spring is provided for biasing the lever into a rest position in which the roller is in alignment with the latches on the strike while the plate is out of alignment with the stop on the strike. When the door is moved into a closed position, the springs permit the roller to step over the two latches in sequence while the plate passes by the stop.

The double action latch is constructed for use particularly on steamer ovens or gas/pressure cabinets to permit opening the cabinet door a limited amount in order to release steam, gas or pressure in a relatively safe, slow restricted manner.

These and other objects and advantages of the invention will become more apparent from the following detailed description taken in conjunction with the accompany drawings wherein:

FIG. 3 illustrates a cross sectional view of the latch in a locking position;

Figure 5:
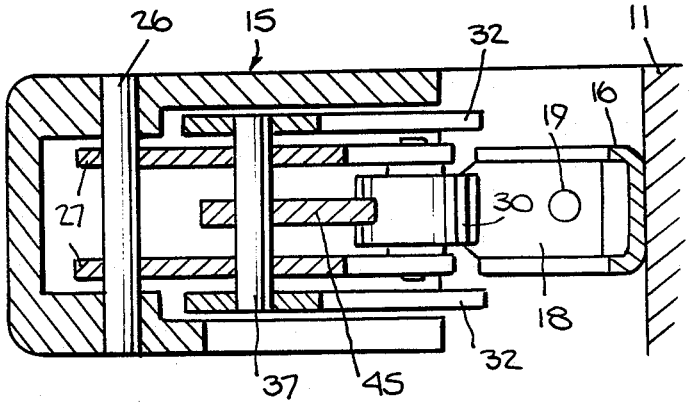
Figure 6:
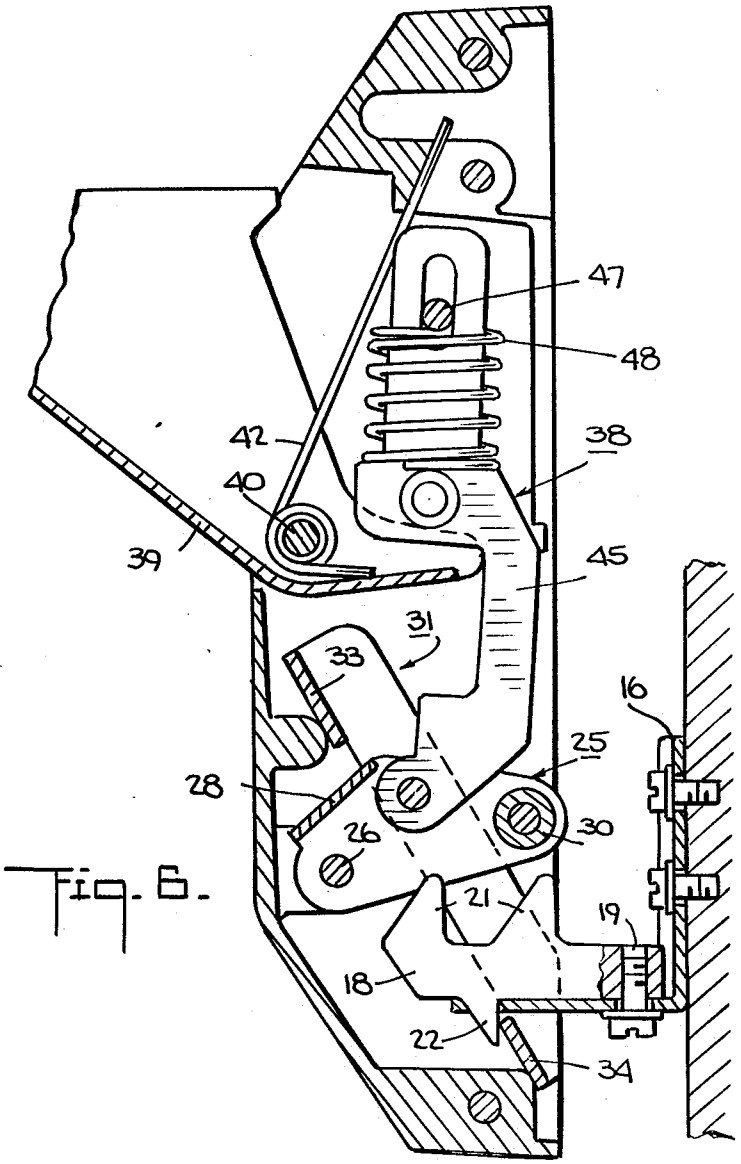
Figure 5:
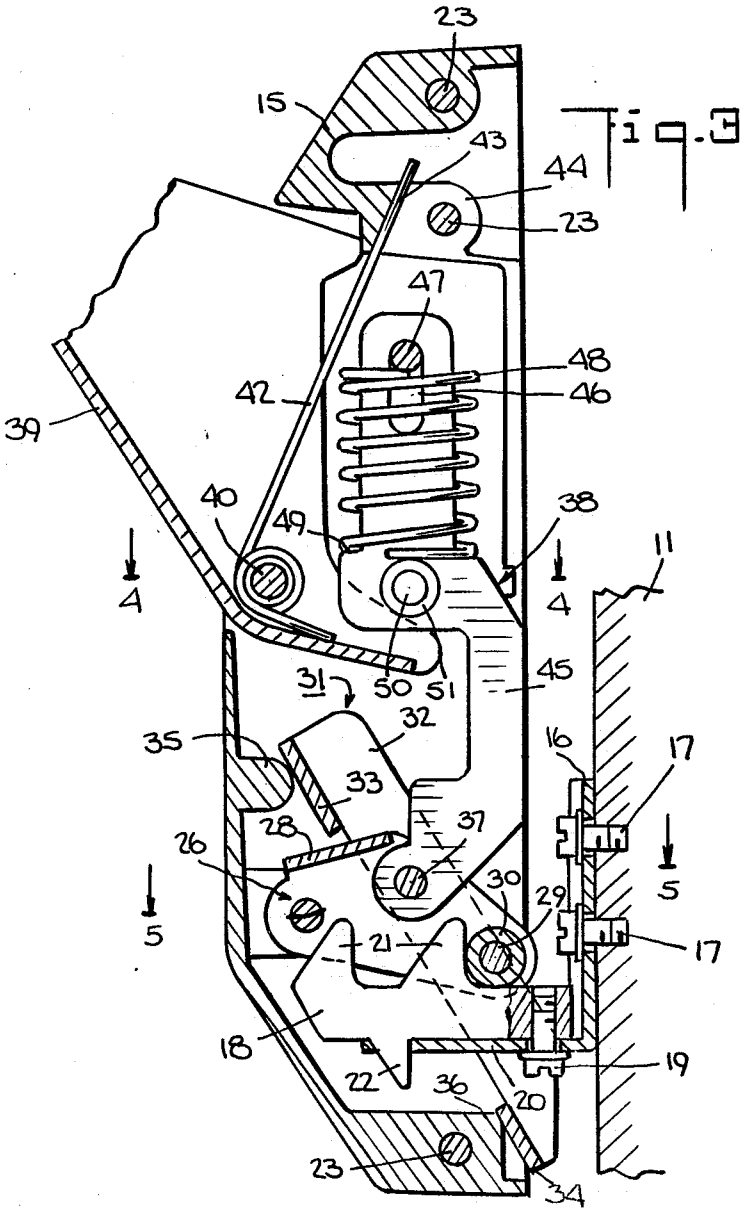
Figure 8:
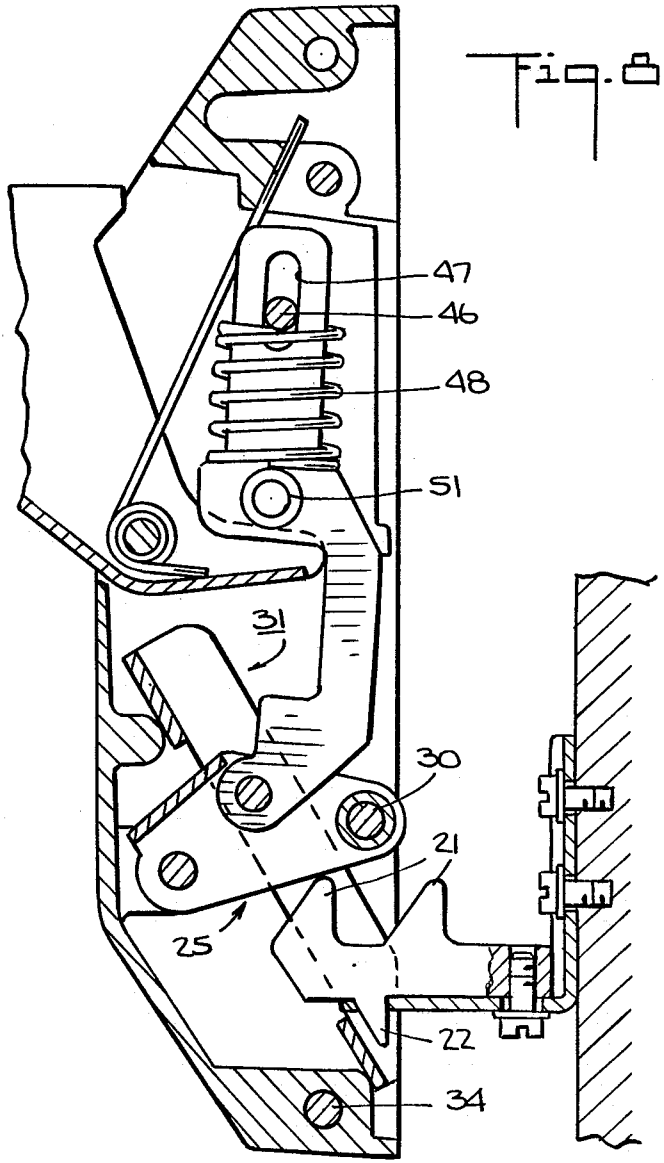
Figure 7:
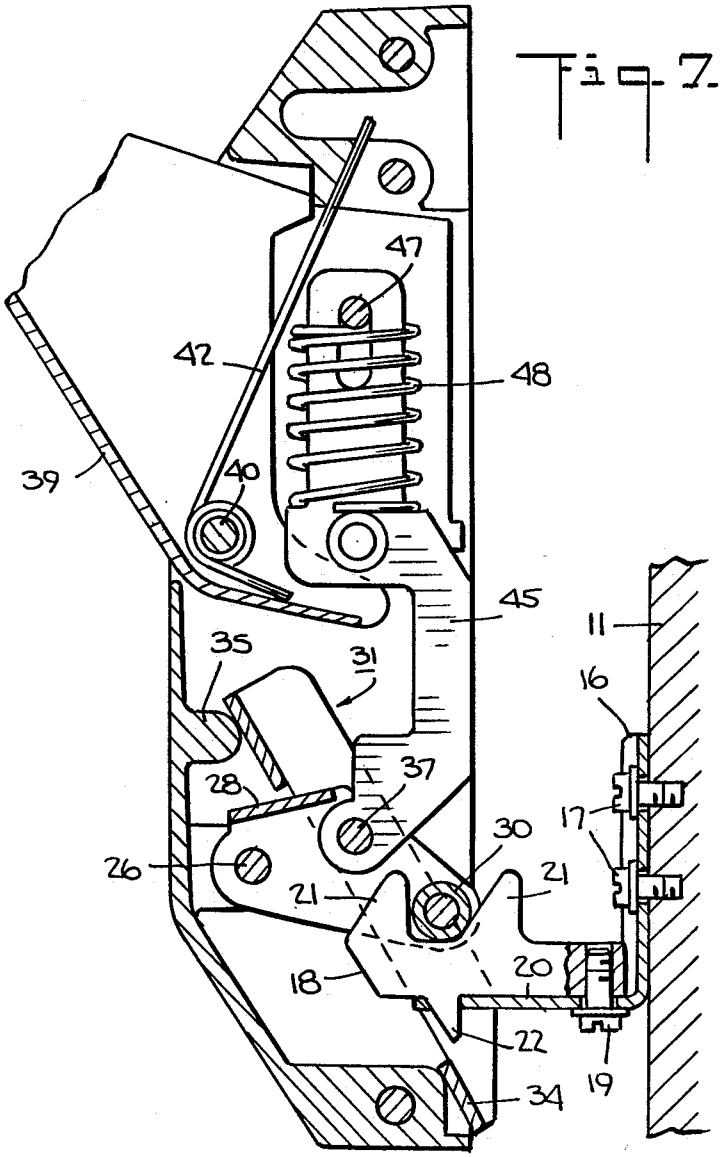
Figure 5:
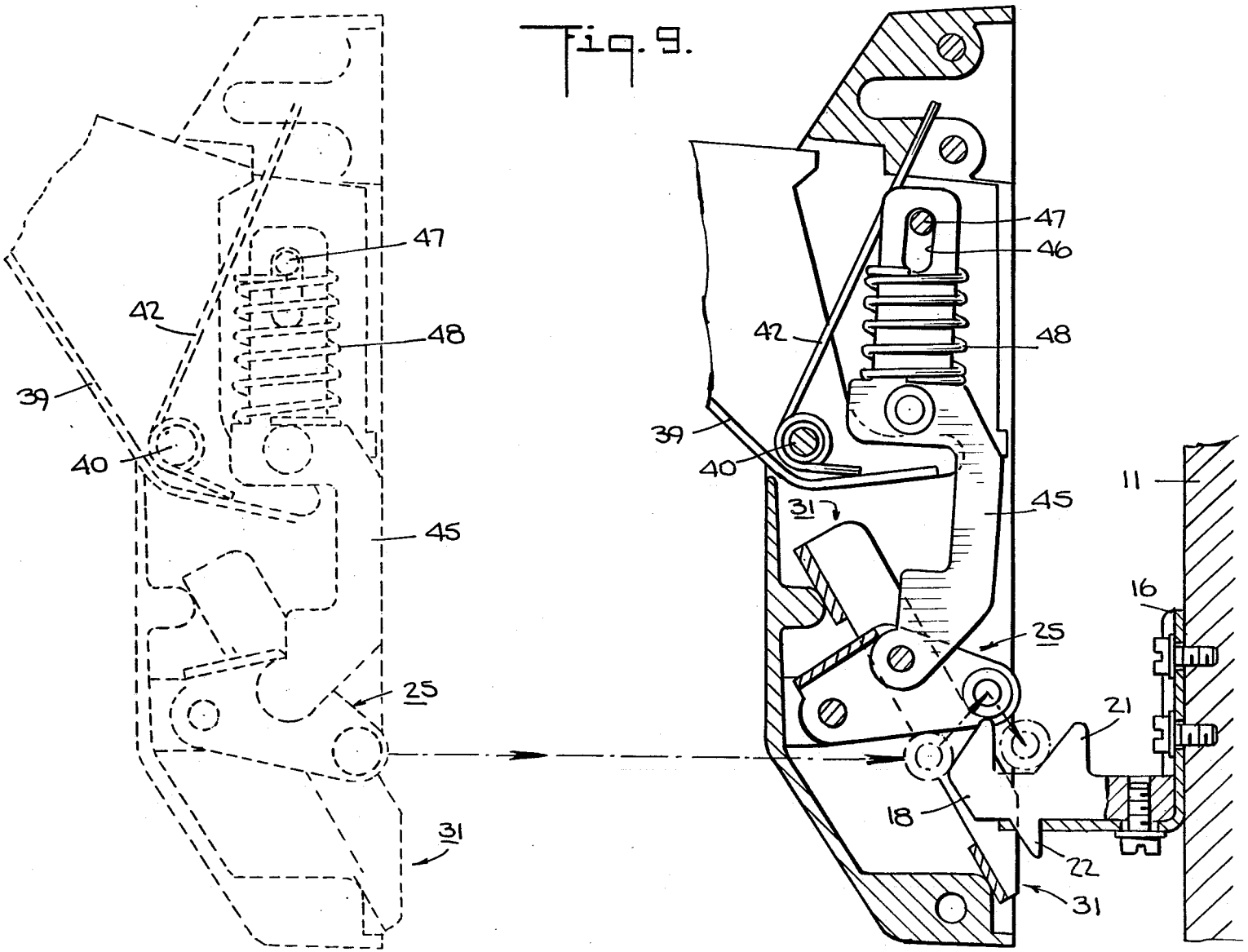

FIG. 5 a view taken on line V—V of FIG. 3;

FIG. 6 illustrates a cross sectional view similar to FIG. 3 of the latch in a partially opened position;

FIG. 7 illustrates a position of the latch in an intermediate lock position;

FIG. 8 illustrates a cross-sectional view of the latch in a fully opened position; and FIG. 9 illustrates a cross-sectional view of the latch in a closing procedure.

Figure 1:
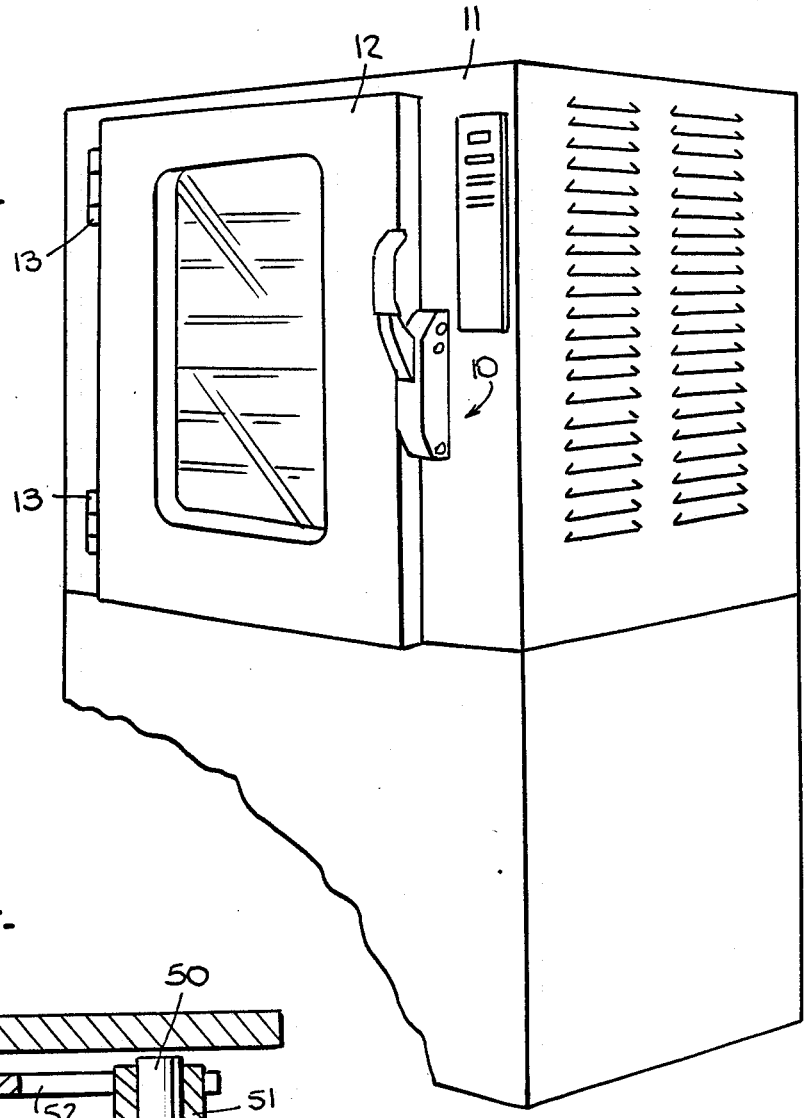
FIG. 1 illustrates a perspective view of a double action latch according to the invention mounted on an oven cabinet.

Referring to FIG. 1, the latch 10 is constructed for mounting on a frame 11, such as an oven cabinet, and a door 12 pivotally mounted on the cabinet 11 as by hinges 13. The oven may be of any suitable types such as a steamer-oven.

Figure 2:
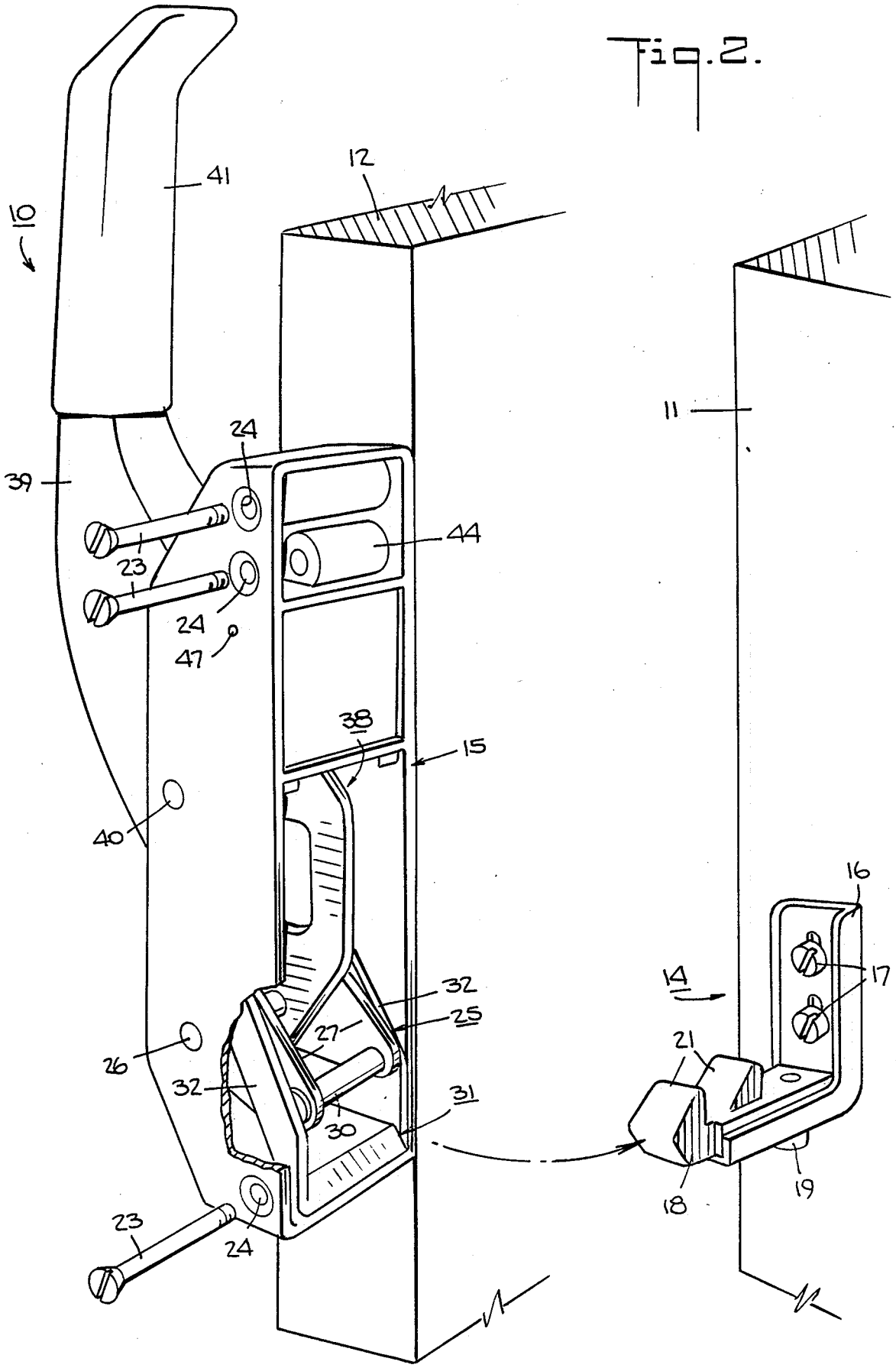
FIG. 2 illustrates a perspective view of the latch of FIG. 1 in an opened position.

Referring to FIG. 2, the double action latch 10 includes a strike assembly 14 and a latch housing 15.

The strike assembly 14 includes an L-shaped mounting bracket 16 which is secured as by a pair of screws 17 to the frame 11. In addition, the strike assembly 14 includes a strike 18 which is secured on the L-shaped mounting bracket 16 by an adjusting screw 19. In this respect, as indicated in FIG. 3, the horizontal leg of the mounting bracket 16 is provided with a slot 20 in which the adjusting screw 19 is located. The undersurface of the strike 18 may also be corrugated or otherwise roughened so as to provide a friction surface for gripping against the mounting bracket 16.

The strike 18 includes a pair of latches 21 which are of saw tooth arrangement and which are spaced apart coaxially of the strike 18. In addition, as indicated in FIG. 3, the strike has a stop 22 on an opposite side from the latches 21 and in a plane intermediate of the latches 21. This stop 22 is sized to slide within the slot 20 of the horizontal leg of the mounting bracket 16 for adjustment purposes. As indicated, the stop 22 is of triangular cross-section.

Each latch 21 is provided with a rearmost flat wall which extends substantially vertically and a forward inclined wall as viewed in FIG. 3. The space between the latches 21 may have a flat base as shown or a curvilinear base (not shown).

Referring to FIG. 2, the housing 15 is of any suitable material such as a die case zinc. As indicated, the housing 15 is secured to a vertical side wall of the door 12 by means of three mounting screws 23. To this end, the housing 15 is provided with suitable passageways 24 for reception of the screws 23 which are to be threaded into the door 12.

Referring to FIGS. 2 and 3, the housing 15 contains a bracket unit 25 which is pivotally mounted on a pivot pin 26 secured across the walls of the housing 15. This bracket unit 5 includes a pair of flanges 27 which are interconnected by a web 28 to form a yoke-like structure. In addition, the unit 25 includes a pin 29 which is fixed to and extends across the flanges 27 and a roller 30 which is rotatably mounted on the pin 29 within the confines of the flanges 27.

A plate unit 31 is also mounted within the housing 15. As indicated in FIG. 3, the plate unit 31 has a pair of parallel flanges 32 which are interconnected by a slide plate 33 at the upper end as well as by a plate 34 at the lower end to form an aperture to accommodate passage of the strike 18. Both plates 33, 34 slide on integral portions of the housing 15 for purposes as explained below.

Figure 4:
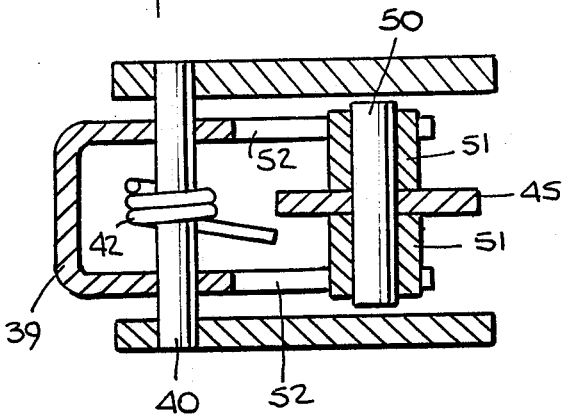
FIG. 4 illustrates a view taken on line IV—IV of FIG. 3.

As indicated in FIGS. 2, 3 and 5, a connecting pin 37 passes through the flanges 27 of the bracket unit 25 into the webs 32 of the plate unit 31 so as to connect the units 25, 31 together. In this respect, as indicated in FIGS. 3 and 4, the bracket unit 25 is pivotable about the pin 26 so as to move the roller 30 between a first rest position in alignment with the latches 21 and a second raised position away from the latches 21 (FIG. 6). The plate unit 31 is mounted in the housing 15 so as to move the plate 34 between a first rest position located below and away from the stop 22 (FIG. 3) and a raised second position in alignment with the stop 22 (FIG. 6).

Referring to FIG. 3, the latch 10 also has an actuating means 38 mounted in the housing 15 which is connected to the roller pin 37 and the plate 34 for moving the roller 30 and plate 34 simultaneously between the respective positions thereof. As indicated, the actuating means 38 includes a handle 39 which is pivotally mounted on a pivot pin 40 extending across the side walls of the housing 15 and which projects upwardly from the housing 15 for manual gripping thereof. As indicated, the handle 39 may be provided with a suitable cover 41 such as other plastic or the like. As indicated in FIG. 3, the handle 10 is biased by a spring 42 disposed about the pivot pin 40 from an unlocking position to a locking position. As indicated, the spring 42 has a short leg abutting an inside wall of the handle 10 and a longer leg abutting against an internal wall 43 of the housing 15. As indicated in FIG. 2, a mounting boss 44 for receiving a mounting screw 23 is interrupted so as to accommodate the long leg of the spring 42.

The actuating means 38 also includes a lever 45 which has an elongated slot 46 at an upper end, as viewed, and which is disposed over a mounting pin 47 extending across the walls of the housing 15. The slot 46 is of sufficient length so as to permit the lever 45 to be raised and lowered a predetermined amount by means of the handle 39.

The lever 45 is pivotally connected to the connecting pin 37 at the lower end and is biased by a spring 48 in a downward direction, as viewed. As illustrated in FIG. 3, the spring 48 extends between the mounting pin 47 and a shouldered portion 49 of the lever 45.

As indicated in FIGS. 3 and 4, the lever 45 carries a pin 50 at an intermediate point which, in turn, carries a pair of rollers 51 which are able to roll along cam surfaces 52 on the handle 39. Thus, upon pivoting of the handle 39 from the upright locking position indicated in FIGS. 2 and 3 into the unlocking position of FIG. 6, the cam surfaces 52 push the lever 45 against the bias of the spring 48 from a rest position into an actuated position. At this time, the lever 45 pivots the bracket unit 25 so as to raise the roller 30 into a position away from the foremost latch 21. At the same time, the plate 34 is raised into alignment with the stop 22 so as to abut against the flat vertical surface of the stop 22.

In use, in order to open the door 12, the handle 39 of the latch 10 is first pulled from the position indicated in FIG. 3 into the position indicated in FIG. 6. At this time, the roller 30 is raised above the plane of the foremost latch 21 while, at the same time, the plate 34 raises up into alignment with the stop 22 and abuts the stop 22. At this time, the handle 39 cannot be further pulled. Also, the door 12 cannot be further opened from the frame 11.

Next, the handle 39 is released and the spring 42 biases the handle 39 back into the upright locking position. At this time, as indicated in FIG. 7, the roller 30 moves into an intermediate locking position between the latches 21. At the same time, the plate 34 is moved below and out of alignment with the stop 22.

If the door 12 is to be fully opened, the handle 39 is again pulled into the unlocking position, as indicated in FIG. 8. At this time, the roller 30 is again pivoted upwardly about the pivot pin 26 out of alignment with the rearmost latch 21. At this time, the plate 34 is again raised but is disposed beyond the stop 22. Thus, upon the roller 30 clearing the uppermost portion of the rearmost latch 21, the door can be pulled fully opened.

Referring to FIGS. 6 and 7, when the handle 39 is released, the spring 42 biases the handle into the upright locking position. At the same time, the spring 48 biases the lever 45 downwardly into the rest position. At this time, the roller 30 rolls down the inclined face of the foremost latch 21 while the plate 34 slides down the rear face of the stop 22. As the plate 34 clears the stop 22, the roller 32 causes the housing 15 to move slightly away from the frame 11. At the same time, the plate 34 is caused to move horizontally beyond the flat rear face of the stop 22 into vertical alignment with the inclined face of the stop 22.

Referring to FIGS. 1 and 9, in order to close the door 12, the door is pivoted about the hinges 13 against the frame 11. At this time, the bracket unit 25 and plate unit 31 operate in rapid sequence against the bias of the spring 48. That is, the roller 30 first contacts the inclined face of the rearmost latch 21 and moves upwardly. At this time, the lever 45 is raised against the bias of the spring 48. Upon reaching the top of the latch 21, the roller drops into the space between the two latches and then begins to move up the included face of the foremost latch 21. At this time, as indicated in FIG. 7, the plate 34 is moved to the right, as viewed, beyond the plane of the stop 22 and is raised vertically. The roller 30 then moves over the foremost latch 21 into the original rest locking position. That is, into the position as shown in FIG. 3.

The invention thus provides a double action latch which can be manually operated using one hand in order to move a door from a locked position to a vented position and thereafter to a fully opened position. The latch permits an oven cabinet to be vented while the latch is in the intermediate position.

The invention further provides a double action latch of relatively simple construction which can be readily mounted on a door, for example on a vertical side wall or a horizontal side wall of the door.

Still further, the invention provides a latch which permits a door to be opened in two distinct pulls of the latch handle using only one hand. Further, the initial pull of the latch handle breaks a door seal and opens the door a limited distance, for example, to permit steam and/or gas pressure in the cabinet to be released slowly and safely. A second independent pull of the handle opens the door fully. In this respect, the door cannot be inadvertently opened in one pull.

What is claimed is:

1. A double action latch comprising a strike having a pair of latches disposed on one side and a stop disposed on an opposite side;

a pivotally mounted bracket unit having a roller for sequentially engaging said latches;

a movable plate for engaging said stop; and actuating means connected to said bracket unit and said plate for pivoting said bracket unit to move said roller out of engagement with a respective latch and for moving said plate into engagement with said stop.

2. A latch as set forth in claim 1 which further comprises a housing having said bracket unit and said plate disposed therein.

3. A latch as set forth in claim 2 wherein said actuating means includes a handle projecting from and movably mounted in said housing for movement between a locking position and an unlocking position and a lever between said handle and said bracket unit for movement between a rest position and an actuated position whereby on moving said handle to said unlocking position said roller is moved into a position away from a respective latch while said plate is moved into a position aligned with said stop.

4. A latch as set forth in claim 2 wherein said actuating means includes a spring biasing said handle into said locking position.

5. A latch as set forth in claim 4 wherein said actuating means includes a second spring biasing said lever into said rest position.

6. A latch as set forth in claim 1 which further comprises a connecting pin connecting said actuating means in common to said bracket unit and said plate.

7. A latch as set forth in claim 1 which further comprises a housing having said bracket unit and said plate disposed therein and wherein said plate is slidably mounted in said housing.

8. A double action latch comprising a strike for mounting on a frame said strike including a pair of latches on one side and a stop on an opposite side;

a housing for mounting on a door pivotally secured to the frame;

a roller mounted in said housing for movement between a first position in alignment with said latches and a second position away from said latches;

a plate mounted in said housing for movement between a first position away from said stop and a second position in alignment with said stop; and actuating means mounted in said housing and connected to said roller and said plate for moving said roller and said plate simultaneously between said first and second positions thereof.

9. A latch as set forth in claim 8 wherein said actuating means includes a handle projecting from and movably mounted in said housing for movement between a locking position and an unlocking position and a lever for movement with said handle and connected to said roller and said plate.

10. A latch set as set forth in claim 9 which further comprises a bracket unit pivotally mounted in said housing and having said roller mounted therein and a connecting pin pivotally connecting said bracket unit to said lever for actuation thereby.

11. A latch as set forth in claim 10 which further comprises said plate slidably mounted in said housing, said plate being mounted on said connecting pin and having an aperture for passage of said strike therethrough.

12. A latch as set forth in claim 9 wherein said actuating means includes a spring biasing said handle into said locking position.

13. A latch as set forth in claim 9 wherein movement of said handle into said unlocking position effects movement of said roller into said second position thereof and said plate into said second position thereof.

14. A latch as set forth in claim 8 which further includes a mounting bracket having said strike adjustable mounted thereon.

15. A latch as set forth in claim 8 wherein said stop is disposed in a plane intermediate of said latches.

16. In combination, a frame;

a door pivotally mounted on said frame;

a strike mounted on said frame and having a pair of latches and a stop;

a housing mounted on said door;

a roller mounted in said housing for movement between a first position in alignment with said latches and a second position away from said latches;

a plate mounted in said housing for movement between a first position away from said stop and a second position in alignment with said stop; and actuating means mounted in said housing and connected to said roller and said plate for moving said roller and said plate simultaneously between said positions thereof.

17. The combination as set forth in claim 16 wherein said actuating means includes a handle projecting from and movably mounted in said housing for movement between a locking position and an unlocking position and a lever for movement with said handle and connected to said roller and said plate movement of said handle into said unlocking position effects movement of said roller into said second position thereof and said plate into second position thereof.

18. The combination as set forth in claim 17 which further comprises a bracket unit pivotally mounted in said housing and having said roller mounted therein and a connecting pin pivotally connecting said bracket unit to said lever for actuation thereby.

19. The combination as set forth in claim 18 which further comprises said plate slidably mounted in said housing, said plate being mounted on said connecting pin and having an aperture for passage of said strike therethrough.

20. The combination as set forth in claim 16 wherein said stop is disposed on an opposite side of said strike from said latches and in a plane intermediate of said latches.

21. The combination as set forth in claim 16 wherein said housing is mounted on a vertical side wall of said door.

22. The combination as set forth in claim 16 wherein said frame encloses an oven.

* * * * *